US011165530B1

(12) United States Patent
Gagnon et al.

(10) Patent No.: US 11,165,530 B1
(45) Date of Patent: Nov. 2, 2021

(54) DFS RADAR DETECTION

(71) Applicant: Hewlett Packard Enterprise Development LP, Houston, TX (US)

(72) Inventors: Jean-Francois Gagnon, St. Laurent (CA); Andre Beaudin, St. Laurent (CA); Myung Cheol Kim, Santa Clara, CA (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 16/863,079

(22) Filed: Apr. 30, 2020

(51) Int. Cl.
*H04K 3/00* (2006.01)

(52) U.S. Cl.
CPC ..... *H04K 3/226* (2013.01); *H04K 3/222* (2013.01); *H04K 3/822* (2013.01); *H04K 2203/18* (2013.01)

(58) Field of Classification Search
CPC .... H04K 3/226; H04K 3/822; H04K 2203/18; H04K 3/222; H04K 3/22; H04K 3/00
See application file for complete search history.

(56) References Cited

U.S. PATENT DOCUMENTS

2009/0160696 A1* 6/2009 Pare ..... G01S 7/021 342/20

* cited by examiner

*Primary Examiner* — Keith Ferguson
(74) *Attorney, Agent, or Firm* — Hewlett Packard Enterprise Patent Department

(57) ABSTRACT

A method for determining presence of a radar includes receiving a plurality of bursts in a dynamic frequency selection (DFS) channel of an access point, storing the plurality of bursts in a queue, in response to the queue comprising a threshold amount of bursts, determining a timespan of a first burst in the queue to a last burst in the queue, partitioning the timespan into at least a first group and a second group, determining a first number of bursts present in the first group and a second number of bursts present in the second group, in response to a difference between the first number of bursts and the second number of bursts equaling more than one, determining the radar is not present, and in response to the difference between the first number of bursts and the second number of bursts equaling one or less, determining radar is present.

20 Claims, 5 Drawing Sheets

DFS RADAR DETECTION

DESCRIPTION OF RELATED ART

Dynamic frequency selection (DFS) is a channel allocation scheme for Wi-Fi to prevent interference with other uses of the frequencies. One example is radar—Doppler weather radar uses the 5 GHz band and when Wi-Fi also uses the 5 GHz band, the weather radar experiences significant degradation. Thus, varies countries or other jurisdictions require Wi-Fi to automatically switch frequencies when radar is detected. However, the detection of a radar pulse may include false positives, even when following the guidelines or regulatory requirements. These false positives may impact the performance of the Wi-Fi network. Thus, improvements are needed to reduce the false detection of radar.

BRIEF DESCRIPTION OF THE DRAWINGS

The present disclosure, in accordance with one or more various embodiments, is described in detail with reference to the following figures. The figures are provided for purposes of illustration only and merely depict typical or example embodiments.

The figures are not exhaustive and do not limit the present disclosure to the precise form disclosed.

DETAILED DESCRIPTION

Improving the DFS functionality of Wi-Fi can directly improve the user experience of Wi-Fi. Some networks may experience high amounts of interference from any number of sources. Sometimes, these interference events may be misinterpreted as radar. The interference may not be repeating—in other words it may be random, and unable to be filtered out by known methods. However, there have been many changes to Wi-Fi, in general, since DFS was standardized in 2003 as part of the Institute of Electrical and Electronics Engineers (IEEE) 802.11h standard.

Among other improvements, inventors have realized that when DFS was originally implemented, standard Wi-Fi access points lacked many of the functionalities and capabilities that they now possess. Using these additional functionalities and capabilities, additional checks that improve the accuracy of detecting radar pulses or bursts may be performed. In particular, this improved radar pulse detection may also include aspects never before considered by the standards or regulations, as well as improvements to aspects previously considered. Each of the different embodiments discussed herein may be performed in conjunction with one or more other embodiments, and/or with one or more previously existing methods of identifying radar. These improvements add to the toolkit available to reduce false positives.

Figure 1:
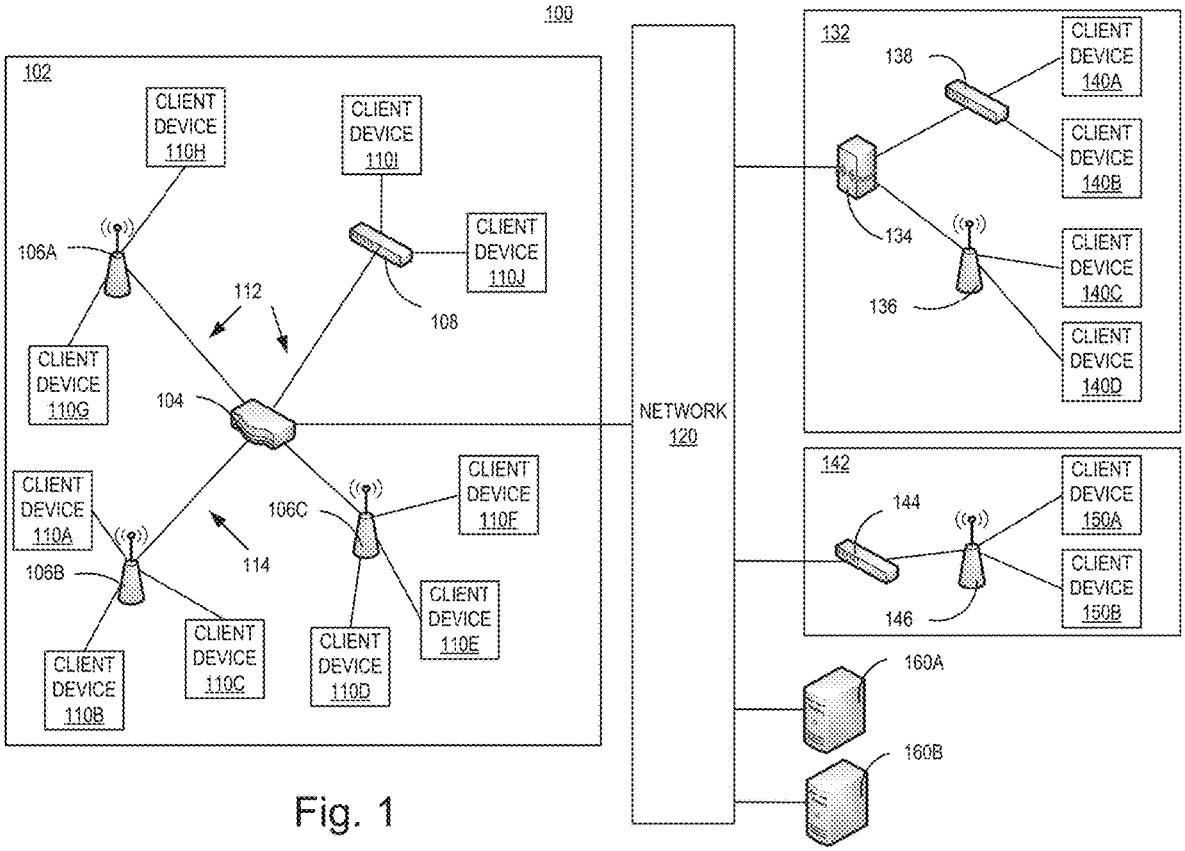
FIG. 1 illustrates one example of a network configuration that may be implemented for an organization, such as a business, educational institution, governmental entity, healthcare facility or other organization.

Before describing embodiments of the disclosed systems and methods in detail, it is useful to describe an example network installation with which these systems and methods might be implemented in various applications. FIG. 1 illustrates one example of a network configuration 100 that may be implemented for an organization, such as a business, educational institution, governmental entity, healthcare facility or other organization. This diagram illustrates an example of a configuration implemented with an organization having multiple users (or at least multiple client devices 110) and possibly multiple physical or geographical sites 102, 132, 142. The network configuration 100 may include a primary site 102 in communication with a network 120. The network configuration 100 may also include one or more remote sites 132, 142, that are in communication with the network 120.

The primary site 102 may include a primary network, which can be, for example, an office network, home network or other network installation. The primary site 102 network may be a private network, such as a network that may include security and access controls to restrict access to authorized users of the private network. Authorized users may include, for example, employees of a company at primary site 102, residents of a house, customers at a business, and so on.

In the illustrated example, the primary site 102 includes a controller 104 in communication with the network 120. The controller 104 may provide communication with the network 120 for the primary site 102, though it may not be the only point of communication with the network 120 for the primary site 102. A single controller 104 is illustrated, though the primary site may include multiple controllers and/or multiple communication points with network 120. In some embodiments, the controller 104 communicates with the network 120 through a router (not illustrated). In other embodiments, the controller 104 provides router functionality to the devices in the primary site 102.

A controller 104 may be operable to configure and manage network devices, such as at the primary site 102, and may also manage network devices at the remote sites 132, 134. The controller 104 may be operable to configure and/or manage switches, routers, access points, and/or client devices connected to a network. The controller 104 may itself be, or provide the functionality of, an access point.

The controller 104 may be in communication with one or more switches 108 and/or wireless Access Points (Aps) 106*a-c*. Switches 108 and wireless APs 106*a-c* provide network connectivity to various client devices 110*a-j*. Using a connection to a switch 108 or AP 106*a-c*, a client device 110*a-j* may access network resources, including other devices on the (primary site 102) network and the network 120.

Examples of client devices may include: desktop computers, laptop computers, servers, web servers, authentication servers, authentication-authorization-accounting (AAA) servers, Domain Name System (DNS) servers, Dynamic Host Configuration Protocol (DHCP) servers, Internet Protocol (IP) servers, Virtual Private Network (VPN) servers, network policy servers, mainframes, tablet computers, e-readers, netbook computers, televisions and similar monitors (e.g., smart TVs), content receivers, set-top boxes, personal digital assistants (PDAs), mobile phones, smart phones, smart terminals, dumb terminals, virtual terminals, video game consoles, virtual assistants, Internet of Things (IOT) devices, and the like.

Within the primary site 102, a switch 108 is included as one example of a point of access to the network established in primary site 102 for wired client devices 110*i-j*. Client devices 11*i-j* may connect to the switch 108 and through the switch 108, may be able to access other devices within the network configuration 100. The client devices 110*i-j* may also be able to access the network 120, through the switch 108. The client devices 11*i-j* may communicate with the switch 108 over a wired 112 connection. In the illustrated example, the switch 108 communicates with the controller 104 over a wired 112 connection, though this connection may also be wireless.

Wireless APs 106*a-c* are included as another example of a point of access to the network established in primary site 102 for client devices 110*a-h*. Each of APs 106*a-c* may be a combination of hardware, software, and/or firmware that is configured to provide wireless network connectivity to wireless client devices 110*a-h*. In the illustrated example, APs 106*a-c* can be managed and configured by the controller 104. APs 106*a-c* communicate with the controller 104 and the network over connections 112, which may be either wired or wireless interfaces.

The network configuration 100 may include one or more remote sites 132. A remote site 132 may be located in a different physical or geographical location from the primary site 102. In some cases, the remote site 132 may be in the same geographical location, or possibly the same building, as the primary site 102, but lacks a direct connection to the network located within the primary site 102. Instead, remote site 132 may utilize a connection over a different network, e.g., network 120. A remote site 132 such as the one illustrated in FIG. 1 may be, for example, a satellite office, another floor or suite in a building, and so on. The remote site 132 may include a gateway device 134 for communicating with the network 120. A gateway device 134 may be a router, a digital-to-analog modem, a cable modem, a Digital Subscriber Line (DSL) modem, or some other network device configured to communicate to the network 120. The remote site 132 may also include a switch 138 and/or AP 136 in communication with the gateway device 134 over either wired or wireless connections. The switch 138 and AP 136 provide connectivity to the network for various client devices 140*a-d*.

In various embodiments, the remote site 132 may be in direct communication with primary site 102, such that client devices 140*a-d* at the remote site 132 access the network resources at the primary site 102 as if these clients devices 140*a-d* were located at the primary site 102. In such embodiments, the remote site 132 is managed by the controller 104 at the primary site 102, and the controller 104 provides the necessary connectivity, security, and accessibility that enable the remote site 132's communication with the primary site 102. Once connected to the primary site 102, the remote site 132 may function as a part of a private network provided by the primary site 102.

In various embodiments, the network configuration 100 may include one or more smaller remote sites 142, comprising only a gateway device 144 for communicating with the network 120 and a wireless AP 146, by which various client devices 150*a-b* access the network 120. Such a remote site 142 may represent, for example, an individual employee's home or a temporary remote office. The remote site 142 may also be in communication with the primary site 102, such that the client devices 150*a-b* at remote site 142 access network resources at the primary site 102 as if these client devices 150*a-b* were located at the primary site 102. The remote site 142 may be managed by the controller 104 at the primary site 102 to make this transparency possible. Once connected to the primary site 102, the remote site 142 may function as a part of a private network provided by the primary site 102.

The network 120 may be a public or private network, such as the Internet, or other communication network to allow connectivity among the various sites 102, 130 to 142 as well as access to servers 160*a-b*. The network 120 may include third-party telecommunication lines, such as phone lines, broadcast coaxial cable, fiber optic cables, satellite communications, cellular communications, and the like. The network 120 may include any number of intermediate network devices, such as switches, routers, gateways, servers, and/or controllers, which are not directly part of the network configuration 100 but that facilitate communication between the various parts of the network configuration 100, and between the network configuration 100 and other network-connected entities. The network 120 may include various content servers 160*a-b*. Content servers 160*a-b* may include various providers of multimedia downloadable and/or streaming content, including audio, video, graphical, and/or text content, or any combination thereof. Examples of content servers 160*a-b* include, for example, web servers, streaming radio and video providers, and cable and satellite television providers. The client devices 110*a* j, 140*a-d*, 150*a-b* may request and access the multimedia content provided by the content servers 160*a-b*.

The portions of network 120 and/or the individual sites 102, 132, 142, may utilize DFS channels for communication. These DFS channels are required to automatically be vacated upon receipt of a valid radar signal. The valid radar signals may correspond to any suitable standard or standards, and may vary based upon the country, region, or jurisdiction in which the network and/or individual site 102, 132, 142 is located. Vacating a DFS channel can impact the experience of users of the network. Thus, it is desirable to not unnecessarily switch channels. However, interference may accidentally look like a radar signal, creating a false positive.

Radar may be received as a plurality of pulses or bursts. These pulses or bursts are received by the access point or other suitable device. The pulses or bursts themselves have characteristics, and others may be calculated based on those. The characteristics may include, but are not limited to: a timestamp, a pulse width, an autocorrelation, a phase linearity, a frequency offset, and a chirp. A timestamp is the time at which a given pulse is received, and may be used to determine the pulse interval, which is the time between consecutive pulses, typically in microseconds. A pulse width, also known as pulse duration, is the duration of pulse transmission time, typically in microseconds. Autocorrelation is the degree of similarity between a given time series and a lagged version of itself over successive time intervals. The autocorrelation may be a rating or score, and not a precise value. Phase linearity is the maximum deviation from a straight line of the plot of the phase versus the frequency. The phase linearity may be a rating or score, and not a precise value. The frequency offset is the offset of the broadcast radio frequency to reduce interference with other transmitters. Chirp is the amount in which the frequency increases or decreases with time.

Figure 2:
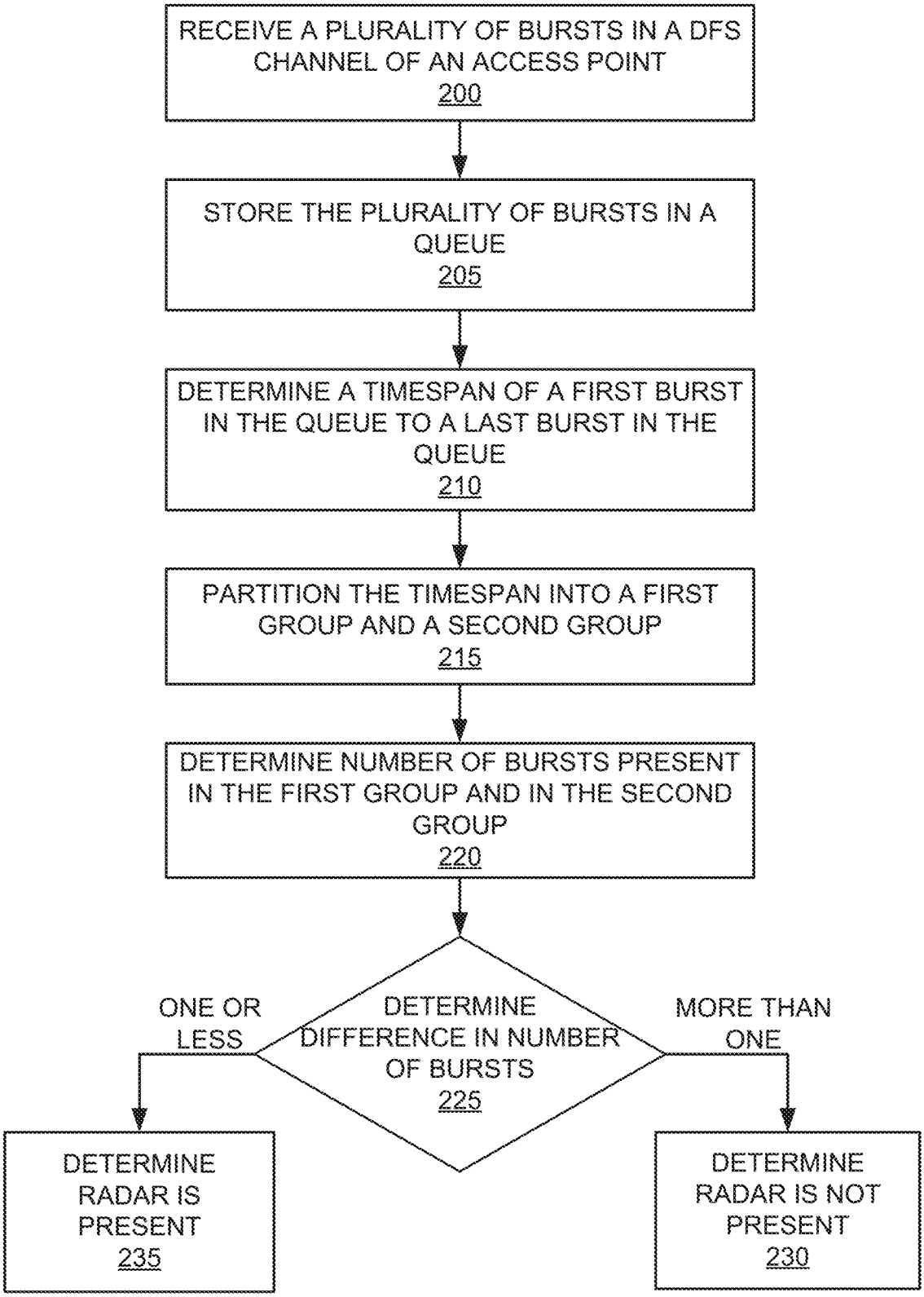
FIG. 2 depicts a flowchart of a method for improved DFS radar detection in accordance with one or more embodiments.

FIG. 2 depicts a flowchart of a method for improved DFS radar detection in accordance with one or more embodiments. Although the steps in FIG. 2 are shown in an order, it is not the only order for the steps. The steps may be performed at any time, in any order. Additionally, the steps may be repeated or omitted as needed.

Additionally, the steps may be performed by any suitable device, such as an access point, controller, switch, computing device, network infrastructure device, etc. The suitable device may include a hardware processor (not shown), such as one or more central processing units (CPUs), semiconductor-based microprocessors, and/or other hardware devices suitable for retrieval and execution of instructions stored in a machine-readable storage medium (not shown). The hardware processor may fetch, decode, and execute instructions, to control processes or operations for improving DFS radar detection in accordance with one or more embodiments. As an alternative or in addition to retrieving and executing instructions, hardware processor may include one or more electronic circuits that include electronic components for performing the functionality of one or more instructions, such as a field programmable gate array (FPGA), application specific integrated circuit (ASIC), or other electronic circuits.

A machine-readable storage medium, may be any electronic, magnetic, optical, or other physical storage device that contains or stores executable instructions. Thus, a machine-readable storage medium may be, for example, Random Access Memory (RAM), non-volatile RAM (NVRAM), an Electrically Erasable Programmable Read-Only Memory (EEPROM), a storage device, an optical disc, and the like. In some embodiments, a machine-readable storage medium may be a non-transitory storage medium, where the term "non-transitory" does not encompass transitory propagating signals.

In step 200, a plurality of bursts are received in a DFS channel of an access point. The plurality of bursts may consist of any number of bursts. The bursts may be received at any interval, from any number of sources, and at any time. The source of the burst may be, for example, a radar or interference. The bursts may be received at any frequency and may be received by one or more access points or other suitable devices.

In step 205, the plurality of bursts are stored in a queue. The queue may be of any size, and store any amount of bursts and/or data about the bursts. Generally, the queue is maintained such that the prior 10 to 12 seconds of bursts are stored in the queue. The duration the queue is maintained may be based on regulatory requirements. For example, for an FCC-5 radar, the regulatory requirement is 12 seconds, while for an FCC-6 radar, the regulatory requirement is 0.3 seconds. Additionally, there may be more than one queue maintained, and therefore step 205 may be performed multiple times, and may even be performed concurrently. The number of queues maintained may be based on regulatory requirements of the country, state, or other jurisdiction in which the access point is present. Alternatively, the number of queues maintained may be based on any other suitable factor. As example, there may be one queue per radar type (e.g., one queue for FCC-5 radar, and a different queue for FCC-6 radar).

In step 210, a timespan from a first burst in the queue to a last burst in the queue is determined. The timespan may be determined in any suitable manner, at any time. The timespan may be determined in response to a determination that there may be a valid radar in the queue, such as based on a number of bursts in the queue. Alternatively, the timespan may be checked constantly and the method may only proceed further when the timespan is over a certain amount of time, such as 10 seconds. Alternatively, the timespan may be determined in response to any other factor or basis. Generally, the timespan will be between 10 and 12 seconds, although other amounts may be possible.

Additionally, step 210 may be performed multiple times, concurrently or not, and multiple different timespans may be tracked or otherwise maintained. This may be the case where there are multiple queues, such as one per radar type or other regulatory requirement. Thus, for example, different timespans may be determined concurrently for an FCC-5 queue and an FCC-6 queue.

In step 215, the timespan is partitioned into a first group and a second group. Although this step discusses two groups, the timespan may be partitioned into any number of groups, at any time, by any suitable entity. Particularly, the inventors have identified 4 groups as having good results. Groups of 3 and 5 also have good results. However, groups of 2, or more than 5, have less accurate results, but still may be used. The groups are continuous and at least approximately equal in time. Thus, if a timespan of 10 seconds is partitioned into 2 groups, each group would be 5 seconds long. Likewise, if the 10 second timespan was partitioned into 4 groups, each group would be 2.5 seconds long. As with steps 205 and 210, step 215 may be performed multiple times, and may be performed concurrently. This may be used when there are multiple timespans to maintain at the same time, as described in Step 210.

In step 220, a number of bursts present in the first group and a number of bursts present in the second group is determined. The number of bursts present in each group may be determined in any suitable manner, at any time, by any suitable entity. As with the prior steps, step 220 may be performed multiple times, and may be performed concurrently. This may be used when there are multiple timespans to maintain at the same time, as described in Step 210.

In step 225, a difference in the number of bursts is determined. The difference may be determined in any suitable manner, at any time, by any suitable entity. Specifically, if there are more than two groups, the difference is between the minimum number of bursts in a group and the maximum number of bursts in a group. If the difference is more than one, the method proceeds to step 230. If the difference is one or less, the method proceeds to step 235. As with the prior steps, step 225 may be performed multiple times, and may be performed concurrently. This may be used when there are multiple timespans to maintain at the same time, as described in Step 210.

In step 230, radar is determined to not be present. This is because the bursts should be relatively evenly distributed across the groups. Thus, if the difference between the maximum number of bursts in a group and the minimum number of bursts in a group is more than one, then at least one of the bursts is from interference and not from radar. Thus, radar is determined to not be present. Any suitable steps may be taken in response to this determination. As with the prior steps, step 230 may be performed multiple times, and may be performed concurrently. This may be used when there are multiple timespans to maintain at the same time, as described in Step 210.

In step 235, radar is determined to be present. After determining that radar is present any suitable steps or actions may be taken. Generally, the channel will be vacated per DFS requirements, although other steps and/or additional step may be taken. As with the prior steps, step 235 may be performed multiple times, and may be performed concurrently. This may be used when there are multiple timespans to maintain at the same time, as described in Step 210.

Optionally, after step 235, the method may be performed again for the same timespan with a different number of groups to further increase accuracy. For example, if the method was performed with 3 groups (3.33 seconds each if the timespan is 10 seconds) and passed, then the method could be run again with 5 groups (2 seconds each) to see if the difference is still one or less. The method may be performed as many times as desired with any numbers of groups used.

Figure 3:
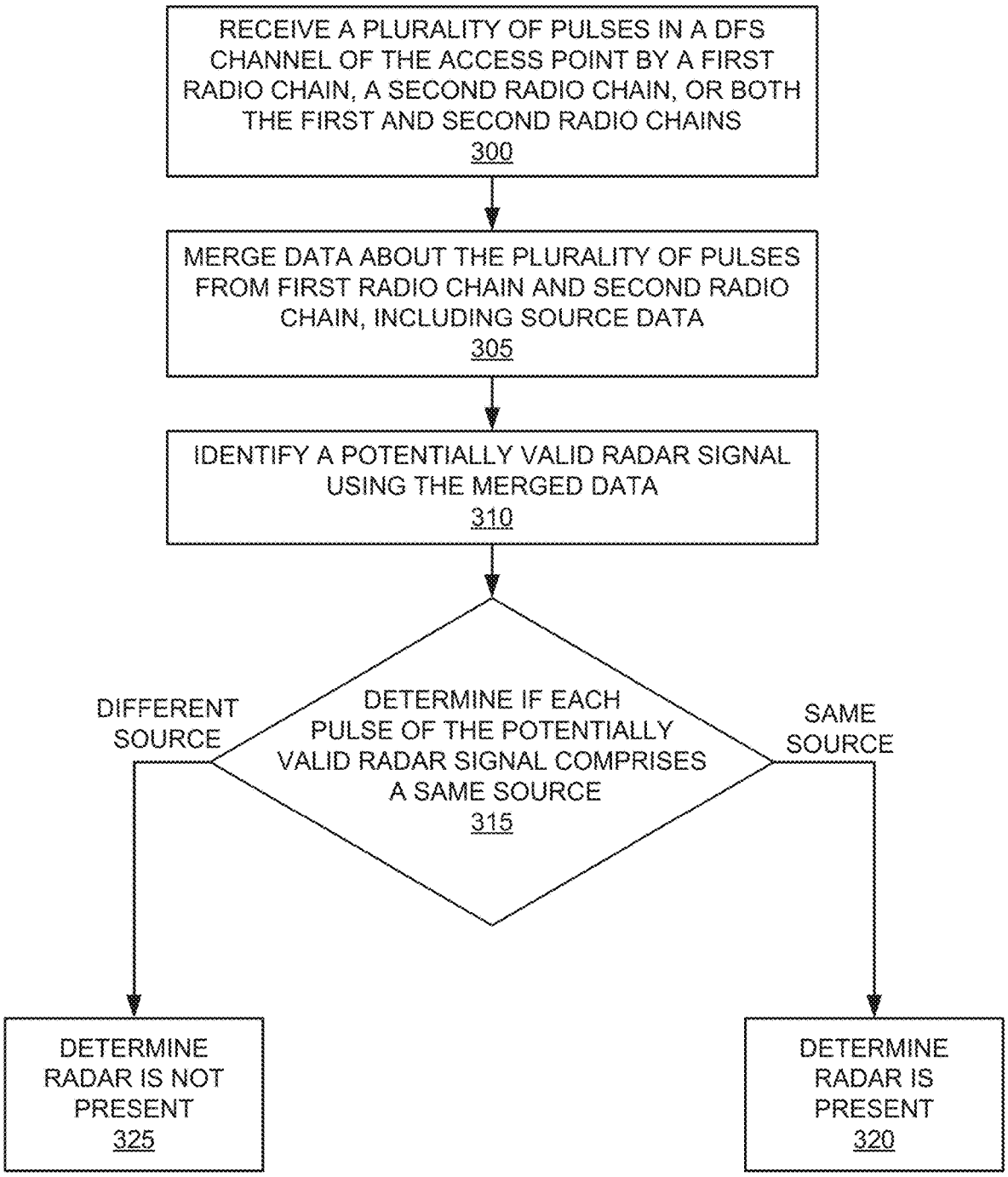
FIG. 3 depicts a flowchart of a method for improved DFS radar detection in accordance with one or more embodiments.

FIG. 3 depicts a flowchart of a method for improved DFS radar detection in accordance with one or more embodiments. Although the steps in FIG. 3 are shown in an order, it is not the only order for the steps. The steps may be performed at any time, in any order. Additionally, the steps may be repeated or omitted as needed.

Additionally, the steps may be performed by any suitable device, such as an access point, controller, switch, computing device, network infrastructure device, etc. The suitable device may include a hardware processor (not shown), such as one or more central processing units (CPUs), semiconductor-based microprocessors, and/or other hardware devices suitable for retrieval and execution of instructions stored in a machine-readable storage medium (not shown). The hardware processor may fetch, decode, and execute instructions, to control processes or operations for improving DFS radar detection in accordance with one or more embodiments. As an alternative or in addition to retrieving and executing instructions, hardware processor may include one or more electronic circuits that include electronic components for performing the functionality of one or more instructions, such as a field programmable gate array (FPGA), application specific integrated circuit (ASIC), or other electronic circuits.

A machine-readable storage medium, may be any electronic, magnetic, optical, or other physical storage device that contains or stores executable instructions. Thus, a machine-readable storage medium may be, for example, Random Access Memory (RAM), non-volatile RAM (NVRAM), an Electrically Erasable Programmable Read-Only Memory (EEPROM), a storage device, an optical disc, and the like. In some embodiments, a machine-readable storage medium may be a non-transitory storage medium, where the term "non-transitory" does not encompass transitory propagating signals.

In step 300, a plurality of pulses are received in a DFS channel of the access point. The pulses are received by a first radio chain, a second radio chain, or both the first and the second radio chain. For the purposes of this description, the pulses are received by up to two radio chains. However, there may be any number of radio chains in an access point, and any number of the radio chains may receive the pulses. Each radio chain may have any number of antennas associated with it. The pulses may be received at any interval, from any number of sources, and at any time. The source of the pulses may be, for example, a radar or interference. The pulses may be received at any frequency and may be received by one or more access points or other suitable devices.

In step 305, data about the plurality of pulses from the first radio chain and the second radio chain is merged. As part of the merging process, the source of the data is included. Specifically, the data from different radio chains are merged to create a single data list with the most accurate information available possible. This merged list may then subsequently be used for analyzing data, such as identifying radar. Previously, source data was not included in this merged list. In other words, the source data was ignored or last in all prior merging processes. This is because, previously, the source data was not considered or used in determining whether radar was present. However, the inventors have realized that the source data is another useful, low-cost, indicator of whether received pulses are radar or interference. Thus, the source data is included in the merged list. The source data may be included in any manner or format.

In step 310, a potentially valid radar signal is identified using the merged data. The potentially valid radar signal may be identified in any manner now known or later developed, and may be based on any available data. Step 310 may be performed in a different order than shown in FIG. 3. Specifically, step 310 may be performed after the determination of whether the sources are the same, or simultaneously to, instead of before.

In step 315, a determination is made whether each pulse of the potentially valid radar signal comprises a same source. The determination may be made in any manner now known or later developed. The same source may be a consistent source rather than an identical source. For example, if pulse A is from radio chain 1, while pulse B is from radio chain 1 and radio chain 2, the sources are the same (i.e., radio chain 1). Generally, this determination seeks to identify when the source of a pulse changes, as a radar will always be sent from a single physical location. Therefore, if a radio chain sees one radar pulse that same radio chain should see all radar pulses.

Optionally, other determinations may be performed here, or the determinations may change based on characteristics of the pulses or characteristics of the access point. As one example, the determinations may vary based on the pulse widths. As another example, pulses for a particular radar, such as FCC-5, may not have their sources checked. Rather, FCC-5 pulses may be checked at a burst level, rather than a pulse level. As another example, the determination may be, or may also include, whether multiple antennas saw the pulses, or that only one antenna saw the pulses (i.e., the second antenna never saw the pulses), or as discussed above, the antenna may be consistent throughout but the second antenna may also periodically see the pulses.

If the sources are the same, then the method proceeds to step 320. If the sources are not the same, then then method proceeds to step 325.

In step 320, the sources are the same and it is determined that radar is present. After determining that radar is present any suitable steps or actions may be taken. Generally, the channel will be vacated per DFS requirements, although other steps and/or additional step may be taken.

In step 325, the sources are different and it is determined that radar is not present. This determination is made because radar will always be sent from a single physical location. Therefore, if a radio chain sees one radar pulse, that same radio chain should see all radar pulses, which has not occurred in this step. Any suitable steps may be taken in response to this determination.

Figure 4A:
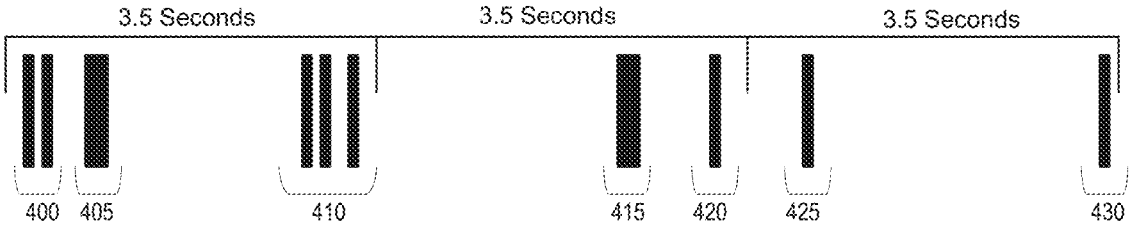
FIG. 4A and FIG. 4B depict examples of improved DFS radar detection in accordance with one or more embodiments.
Figure 4B:
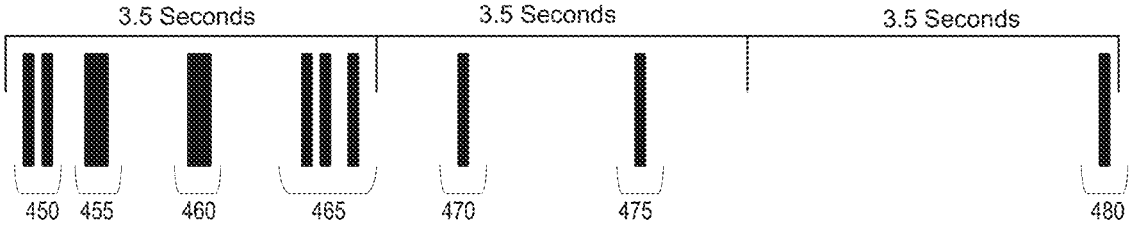

FIG. 4A and FIG. 4B depict examples of improved DFS radar detection in accordance with one or more embodiments. In particular, FIG. 4A shows a valid radar check using the method of FIG. 2. While FIG. 4B shows an invalid radar check using the method of FIG. 2.

Turning to FIG. 4A, a plurality of bursts are shown. The bursts 400, 405, 410, 415, 420, 425, 430 have a timespan of 10.5 seconds and may represent radar—the method of FIG. 2 will be used to check. Thus, the timespan is divided into 3 equal groups of 3.5 seconds each. In the first group there are 3 bursts 400, 405, and 410. In the second group there are 2 bursts 415 and 420. In the third group there are two bursts 425 and 430. The difference between the maximum number of bursts (3) and the minimum number of bursts (2) is 1. Thus, the signal in FIG. 4A is radar.

Turning to FIG. 4B, a plurality of bursts are shown. The bursts 450, 455, 460, 465, 470, 475, 480 have a timespan of 10.5 seconds and may represent radar—the method of FIG. 2 will be used to check. Thus, the timespan is divided into 3 equal groups of 3.5 seconds each. In the first group there are 4 bursts 450, 455, 460, 465. In the second group there are 2 bursts 470 and 475. In the third group there is 1 burst 480. The difference between the maximum number of bursts (4) and the minimum number of bursts (1) is 3. Thus, the signal in FIG. 4B is not radar as at least one of the bursts was interference.

Figure 5:
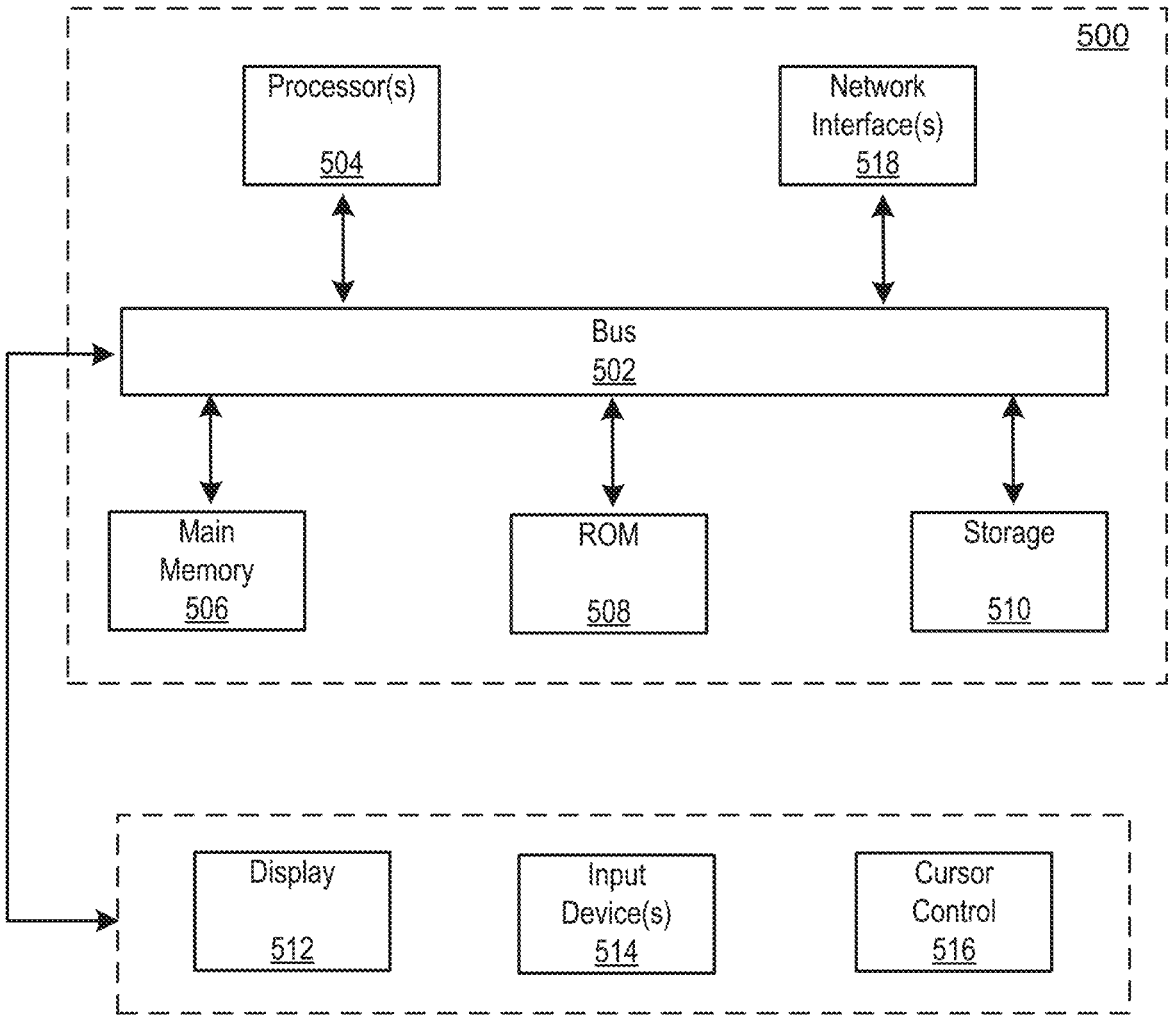
FIG. 5 depicts a block diagram of an example computer system in which various of the embodiments described herein may be implemented.

FIG. 5 depicts a block diagram of an example computer system 500 in which various of the embodiments described herein may be implemented. The computer system 500 includes a bus 502 or other communication mechanism for communicating information, one or more hardware processors 504 coupled with bus 502 for processing information. Hardware processor(s) 504 may be, for example, one or more general purpose microprocessors.

The computer system 500 also includes a main memory 506, such as a random access memory (RAM), cache and/or other dynamic storage devices, coupled to bus 502 for storing information and instructions to be executed by processor 504. Main memory 506 also may be used for storing temporary variables or other intermediate information during execution of instructions to be executed by processor 504. Such instructions, when stored in storage media accessible to processor 504, render computer system 500 into a special-purpose machine that is customized to perform the operations specified in the instructions.

The computer system 500 further includes a read only memory (ROM) 508 or other static storage device coupled to bus 502 for storing static information and instructions for processor 504. A storage device 510, such as a magnetic disk, optical disk, or USB thumb drive (Flash drive), etc., is provided and coupled to bus 502 for storing information and instructions.

The computer system 500 may be coupled via bus 502 to a display 512, such as a liquid crystal display (LCD) (or touch screen), for displaying information to a computer user. An input device 514, including alphanumeric and other keys, is coupled to bus 502 for communicating information and command selections to processor 504. Another type of user input device is cursor control 516, such as a mouse, a trackball, or cursor direction keys for communicating direction information and command selections to processor 504 and for controlling cursor movement on display 512. In some embodiments, the same direction information and command selections as cursor control may be implemented via receiving touches on a touch screen without a cursor.

The computing system 500 may include a user interface module to implement a GUI that may be stored in a mass storage device as executable software codes that are executed by the computing device(s). This and other modules may include, by way of example, components, such as software components, object-oriented software components, class components and task components, processes, functions, attributes, procedures, subroutines, segments of program code, drivers, firmware, microcode, circuitry, data, databases, data structures, tables, arrays, and variables.

In general, the word "component," "system," "database," and the like, as used herein, can refer to logic embodied in hardware or firmware, or to a collection of software instructions, possibly having entry and exit points, written in a programming language, such as, for example, Java, C or C++. A software component may be compiled and linked into an executable program, installed in a dynamic link library, or may be written in an interpreted programming language such as, for example, BASIC, Perl, or Python. It will be appreciated that software components may be callable from other components or from themselves, and/or may be invoked in response to detected events or interrupts. Software components configured for execution on computing devices may be provided on a computer readable medium, such as a compact disc, digital video disc, flash drive, magnetic disc, or any other tangible medium, or as a digital download (and may be originally stored in a compressed or installable format that requires installation, decompression or decryption prior to execution). Such software code may be stored, partially or fully, on a memory device of the executing computing device, for execution by the computing device. Software instructions may be embedded in firmware, such as an EPROM. It will be further appreciated that hardware components may be comprised of connected logic units, such as gates and flip-flops, and/or may be comprised of programmable units, such as programmable gate arrays or processors.

The computer system 500 may implement the techniques described herein using customized hard-wired logic, one or more ASICs or FPGAs, firmware and/or program logic which in combination with the computer system causes or programs computer system 500 to be a special-purpose machine. According to one embodiment, the techniques herein are performed by computer system 500 in response to processor(s) 504 executing one or more sequences of one or more instructions contained in main memory 506. Such instructions may be read into main memory 506 from another storage medium, such as storage device 510. Execution of the sequences of instructions contained in main memory 506 causes processor(s) 504 to perform the process steps described herein. In alternative embodiments, hard-wired circuitry may be used in place of or in combination with software instructions.

The term "non-transitory media," and similar terms, as used herein refers to any media that store data and/or instructions that cause a machine to operate in a specific fashion. Such non-transitory media may comprise non-volatile media and/or volatile media. Non-volatile media includes, for example, optical or magnetic disks, such as storage device 510. Volatile media includes dynamic memory, such as main memory 506. Common forms of non-transitory media include, for example, a floppy disk, a flexible disk, hard disk, solid state drive, magnetic tape, or any other magnetic data storage medium, a CD-ROM, any other optical data storage medium, any physical medium with patterns of holes, a RAM, a PROM, and EPROM, a FLASH-EPROM, NVRAM, any other memory chip or cartridge, and networked versions of the same.

Non-transitory media is distinct from but may be used in conjunction with transmission media. Transmission media participates in transferring information between non-transitory media. For example, transmission media includes coaxial cables, copper wire and fiber optics, including the wires that comprise bus 502. Transmission media can also take the form of acoustic or light waves, such as those generated during radio-wave and infra-red data communications.

The computer system 500 also includes a communication interface 518 coupled to bus 502. Network interface 518 provides a two-way data communication coupling to one or more network links that are connected to one or more local networks. For example, communication interface 518 may be an integrated services digital network (ISDN) card, cable modem, satellite modem, or a modem to provide a data communication connection to a corresponding type of telephone line. As another example, network interface 518 may be a local area network (LAN) card to provide a data communication connection to a compatible LAN (or WAN component to communicate with a WAN). Wireless links may also be implemented. In any such implementation, network interface 518 sends and receives electrical, electromagnetic or optical signals that carry digital data streams representing various types of information.

A network link typically provides data communication through one or more networks to other data devices. For example, a network link may provide a connection through local network to a host computer or to data equipment operated by an Internet Service Provider (ISP). The ISP in turn provides data communication services through the world wide packet data communication network now commonly referred to as the "Internet." Local network and Internet both use electrical, electromagnetic or optical signals that carry digital data streams. The signals through the various networks and the signals on network link and through communication interface 518, which carry the digital data to and from computer system 500, are example forms of transmission media.

The computer system 500 can send messages and receive data, including program code, through the network(s), network link and communication interface 518. In the Internet example, a server might transmit a requested code for an application program through the Internet, the ISP, the local network and the communication interface 518. The received code may be executed by processor 504 as it is received, and/or stored in storage device 510, or other non-volatile storage for later execution.

Each of the processes, methods, and algorithms described in the preceding sections may be embodied in, and fully or partially automated by, code components executed by one or more computer systems or computer processors comprising computer hardware. The one or more computer systems or computer processors may also operate to support performance of the relevant operations in a "cloud computing" environment or as a "software as a service" (SaaS). The processes and algorithms may be implemented partially or wholly in application-specific circuitry. The various features and processes described above may be used independently of one another, or may be combined in various ways. Different combinations and sub-combinations are intended to fall within the scope of this disclosure, and certain method or process blocks may be omitted in some implementations. The methods and processes described herein are also not limited to any particular sequence, and the blocks or states relating thereto can be performed in other sequences that are appropriate, or may be performed in parallel, or in some other manner. Blocks or states may be added to or removed from the disclosed example embodiments. The performance of certain of the operations or processes may be distributed among computer systems or computers processors, not only residing within a single machine, but deployed across a number of machines.

As used herein, a circuit might be implemented utilizing any form of hardware, software, or a combination thereof. For example, one or more processors, controllers, ASICs, PLAs, PALs, CPLDs, FPGAs, logical components, software routines or other mechanisms might be implemented to make up a circuit. In implementation, the various circuits described herein might be implemented as discrete circuits or the functions and features described can be shared in part or in total among one or more circuits. Even though various features or elements of functionality may be individually described or claimed as separate circuits, these features and functionality can be shared among one or more common circuits, and such description shall not require or imply that separate circuits are required to implement such features or functionality. Where a circuit is implemented in whole or in part using software, such software can be implemented to operate with a computing or processing system capable of carrying out the functionality described with respect thereto, such as computer system 500.

As used herein, the term "or" may be construed in either an inclusive or exclusive sense. Moreover, the description of resources, operations, or structures in the singular shall not be read to exclude the plural. Conditional language, such as, among others, "can," "could," "might," or "may," unless specifically stated otherwise, or otherwise understood within the context as used, is generally intended to convey that certain embodiments include, while other embodiments do not include, certain features, elements and/or steps.

Terms and phrases used in this document, and variations thereof, unless otherwise expressly stated, should be construed as open ended as opposed to limiting. As examples of the foregoing, the term "including" should be read as meaning "including, without limitation" or the like. The term "example" is used to provide exemplary instances of the item in discussion, not an exhaustive or limiting list thereof. The terms "a" or "an" should be read as meaning "at least one," "one or more" or the like. The presence of broadening words and phrases such as "one or more," "at least," "but not limited to" or other like phrases in some instances shall not be read to mean that the narrower case is intended or required in instances where such broadening phrases may be absent.

What is claimed is:

1. A method for determining presence of a radar, comprising:

receiving, by an access point, a plurality of bursts in a dynamic frequency selection (DFS) channel of the access point;

storing, by the access point, the plurality of bursts in a queue;

in response to the queue comprising a threshold amount of bursts and by the access point, determining a timespan of a first burst in the queue to a last burst in the queue;

partitioning, by the access point, the timespan into at least a first group and a second group;

determining, by the access point, a first number of bursts present in the first group and a second number of bursts present in the second group;

in response to a difference between the first number of bursts and the second number of bursts equaling more than one, determining, by the access point, the radar is not present; and in response to the difference between the first number of bursts and the second number of bursts equaling one or less, determining, by the access point, the radar is present.

2. The method of claim 1, further comprising:

partitioning the timespan into a different number of groups; and repeating the determining steps for the different number of groups.

3. The method of claim 2, wherein the different number of groups comprises four groups.

4. The method of claim 1, wherein the queue maintains a burst of the plurality of bursts for a set time period before the burst is removed from the queue.

5. The method of claim 4, wherein the set time period is twelve seconds.

6. The method of claim 1, wherein, in response to determining the radar is not present, the access point resets a flag or counter associated with identifying the radar.

7. The method of claim 1, wherein, in response to determining the radar is present, the access point changes to a different channel.

8. The system of claim 1, the instructions further causing the processor to:

partition the timespan into a different number of groups; and repeat the determining steps for the different number of groups.

9. The system of claim 8, wherein the different number of groups comprises four groups.

10. A system comprising:

a hardware processor;

a memory, storing instructions which, when executed by the processor, cause the processor to:

receive a plurality of bursts in a dynamic frequency selection (DFS) channel;

store the plurality of bursts in a queue;

in response to the queue comprising a threshold amount of bursts, determine a timespan of a first burst in the queue to a last burst in the queue;

partition the timespan into at least a first group and a second group;

determine a first number of bursts present in the first group and a second number of bursts present in the second group;

in response to a difference between the first number of bursts and the second number of bursts equaling more than one, determine the radar is not present; and in response to the difference between the first number of bursts and the second number of bursts equaling one or less, determine the radar is present.

11. The system of claim 10, wherein the queue maintains a burst of the plurality of bursts for a set time period before the burst is removed from the queue.

12. The system of claim 11, wherein the set time period is twelve seconds.

13. The system of claim 10, wherein, in response to determining the radar is not present, the access point resets a flag or counter associated with identifying the radar.

14. The system of claim 10, wherein, in response to determining the radar is present, the access point changes to a different channel.

15. A method for determining presence of a radar, comprising:

receiving, by an access point, a plurality of pulses in a dynamic frequency selection (DFS) channel, wherein the plurality of pulses are received by a first radio chain, a second radio chain, or both the first radio chain and the second radio chain;

merging, by the access point, data about the plurality of pulses from the first radio chain and data about the plurality of pulses from the second radio chain to create a merged list of the plurality of pulses, wherein the merged list includes a source of the data about the plurality of pulses;

identifying, by the access point and using the merged list, a potentially valid radar signal;

determining, by the access point and using the merged list, whether each pulse of the potentially valid radar signal comprises a same source;

wherein the potentially valid radar signal is determined to identify the radar when each pulse of the potentially valid radar comprises the same source;

wherein the potentially valid radar signal is determined to not identify the radar when at least one pulse of the potentially valid radar signal does not have the same source.

16. The method of claim 15, wherein the same source comprises the first radio chain or the second radio chain.

17. The method of claim 15, wherein the same source comprises the first radio chain and the second radio chain.

18. The method of claim 15, wherein the data about the plurality of pulses comprises one or more of: a time, a pulse width, an autocorrelation, a chirp, a phase linearity, and a frequency offset.

19. The method of claim 18, wherein the potentially valid radar signal is identified based on the data about the plurality of pulses.

20. The method of claim 15, wherein, in response to identifying the radar, the access point changes to a different channel.

* * * * *